United States Patent [19]

Ruff et al.

[11] Patent Number: 5,072,773

[45] Date of Patent: Dec. 17, 1991

[54] MOLD AND METHOD FOR MAKING VARIABLE HARDNESS CASTINGS

[75] Inventors: Gary F. Ruff, Farmington Hills; Karl D. Voss, Standish; Peter M. Naysmith, Jr., Allen Park; James L. De Rupa, Trenton, all of Mich.

[73] Assignee: CMI International, Inc., Southfield, Mich.

[21] Appl. No.: 612,257

[22] Filed: Nov. 13, 1990

[51] Int. Cl.[5] ..... B22D 15/00

[52] U.S. Cl. ..... 164/127; 164/352; 164/355

[58] Field of Search ..... 164/127, 352, 353, 355, 164/356, 122.1, 122

[56] References Cited

U.S. PATENT DOCUMENTS 638,774 12/1899 Thackray ..... 164/355
843,679 2/1907 Johns ..... 164/352

FOREIGN PATENT DOCUMENTS 13238 1/1987 Japan ..... 164/352
62245 3/1989 Japan ..... 164/353
11-86244 7/1989 Japan ..... 164/352
694277 7/1953 United Kingdom ..... 164/127

*Primary Examiner*—Richard K. Seidel
*Attorney, Agent, or Firm*—Harness, Dickey & Pierce

[57] ABSTRACT

A mold within which molten metal is sand cast, is provided with strategically located chill plates which shape and rapidly cool the molten metal at predetermined locations for hardening those locations relative to the hardness of the remainder of the casting. The mold is formed of a cope and drag frame type flask within which sand is compacted to form the sand cavity. Plates are arranged transversely of the casting cavity and are secured to portions of the flask frame for dissipating heat through the plates and out through the frame. The plates are fixed to portions of the flask and are arranged in opposing pairs which are aligned, coplanar, in abutting relationship. Each plate of each pair is provided with a notch, aligned with its opposite plate, for encircling the portion of the casting to be chill hardened. The pattern used for forming the cavity extends through the aligned notches and between the plates to form the composite sand and metal plate casting surface in the cavity.

7 Claims, 2 Drawing Sheets

FIG - 1
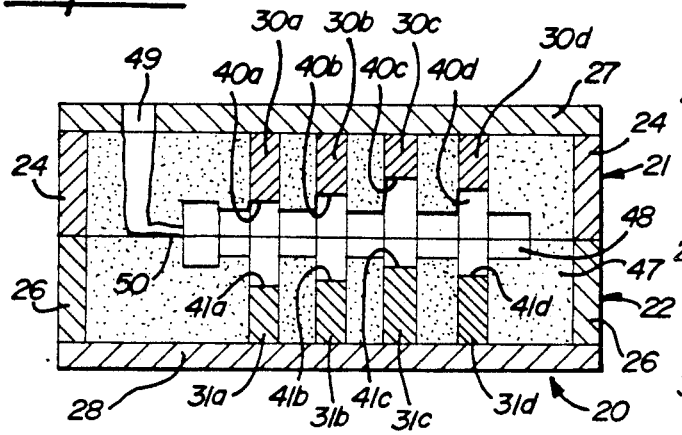
FIG - 2
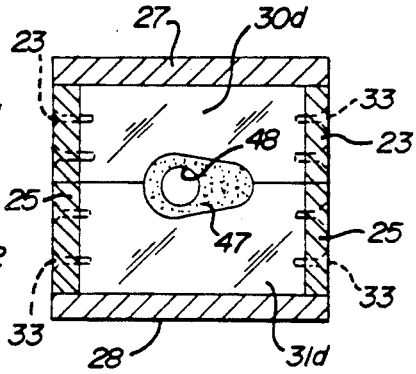
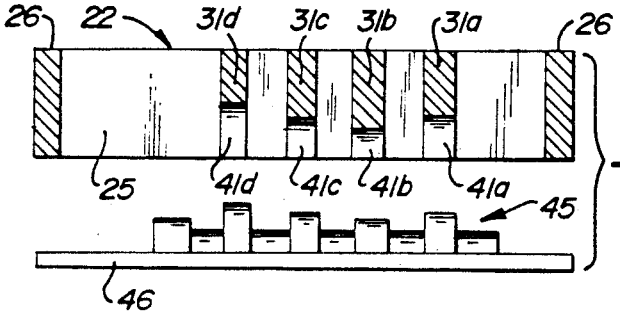
FIG - 3
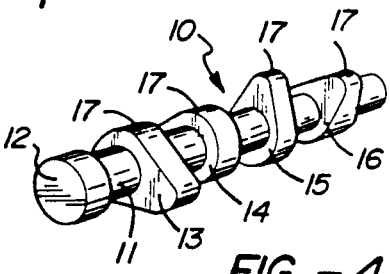
FIG - 4
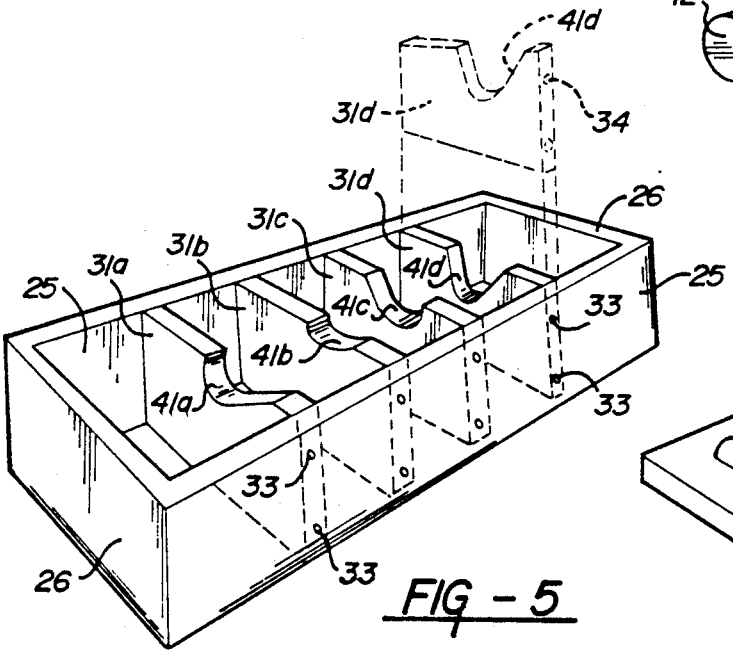
FIG - 5
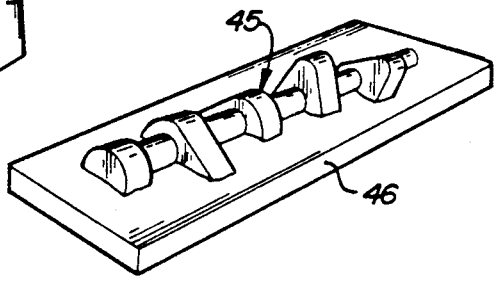
FIG - 6

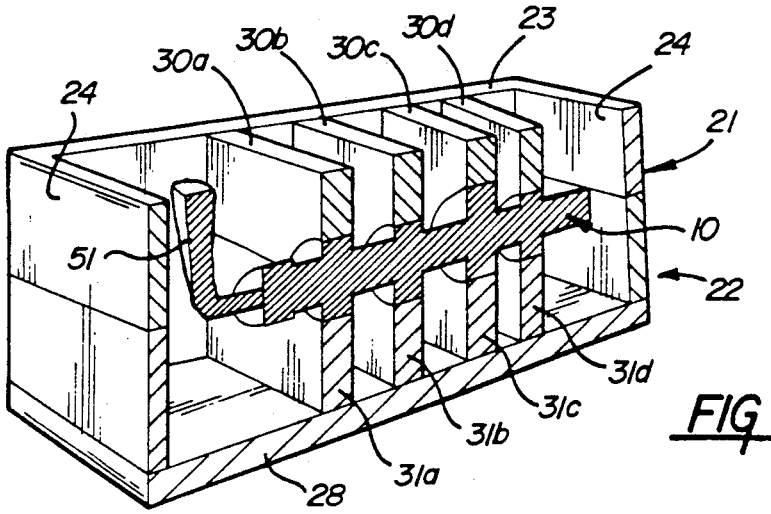
FIG - 7
FIG - 8
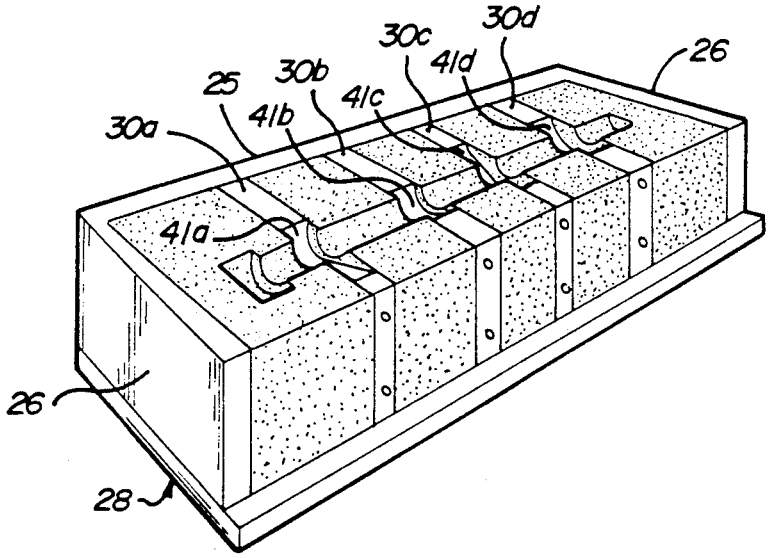
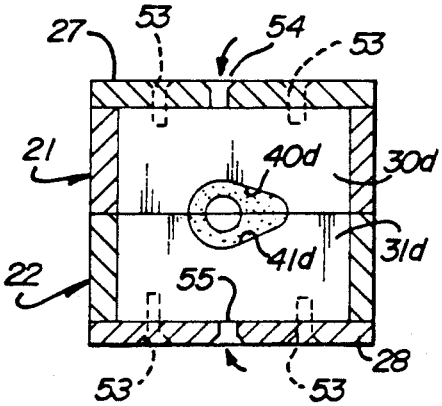
FIG - 9
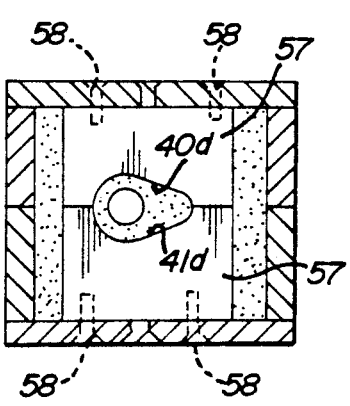
FIG - 10
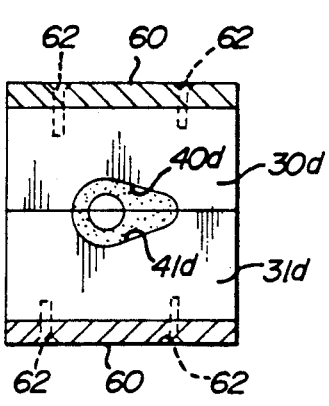
FIG - 11

MOLD AND METHOD FOR MAKING VARIABLE HARDNESS CASTINGS

BACKGROUND OF INVENTION

This invention relates to a mold and a method for casting metal parts within a sand cavity, within which metal chill plates are located, to produce hardened surface areas at predetermined locations on the parts.

In industrial applications, it is common to cast metal parts within a sand mold and, thereafter, harden preselected locations on the parts by heat treating or other known procedures. By way of example, automotive type engine cam shafts are typically cast in sand molds. Later, their projections or lobes are heat treated or nitrided or otherwise processed to harden the peripheral surfaces of the lobes. Other industrial parts, that are made of ferrous metals or alloys, are similarly manufactured.

In many cases, it would be desirable to harden selected areas on the surface of a casting during the casting process in order to reduce the number of manufacturing steps required for hardening after casting. Thus, attempts have been made in the past to utilize chills, that is, metal inserts arranged within or around the casting cavities of a mold. These chills rapidly cool molten metal poured into the mold cavity and, therefore, increase the surface hardness of the rapidly chilled areas. However, chill devices are relatively awkward to handle and to position properly during the preparation of a mold for casting molten metal. In use, they generally require additional labor and time. Chills are particularly awkward to use where the cast part has a considerable number of locations which require chill induced surface hardness.

Particularly in the case of automotive engine cam shafts and similar types of engine parts, the utilization of strategically located chills could materially reduce the number of steps needed for post-casting hardening of selected locations. But this requires a system for rapidly and easily handling, positioning and fixing the chills within a sand casting mold. Thus, the invention herein is concerned with a mold and a method utilizing strategically located chill plates in a manner which is simple and inexpensive so as to permit the use of such chill plates in mass production casting operations.

SUMMARY OF INVENTION

This invention relates to a mold and a method for casting metal parts within a sand cavity containing strategically located chill plates for selectively hardening portions of the casting. The invention contemplates the utilization of a sand casting flask formed of a cope frame and a drag frame which are sand filled and provide the casting cavity. Chill plates are secured within the cope and drag frames, generally transversely of the article to be cast, and are provided with notches or edge openings which enclose and form projections or lobes on the cast article. As the molten metal, which is poured into the cavity, enters the notched plate portions, the metal rapidly freezes and not only hardens into predetermined shapes, but also is surface hardened due to the chill effect.

This invention also contemplates providing chill plates within a sand cavity mold in a manner which conducts heat from the molten metal poured into the mold cavity, through the chill plates and outwardly to atmosphere through heat dispelling portions of the flask. Thus, the cooling of surfaces formed by the molten metal engagement with the chill plate pre-formed notches, is accelerated.

This invention further contemplates a system for casting engine timing cams and similar types of devices having elongated bodies with transverse projections or lobes whose surfaces are to be hardened relative to the surfaces of the remainder of the casting. Thus, a cope and drag frame flask is utilized with a sand filling, within which a casting cavity is formed. Plates are arranged transversely of the flask frames and are provided with opposed notches or cut-out areas which form portions of the wall surface of the cavity. The notch areas are shaped to correspond to the finished surface portions of the cast part which are to be hardened when the molten metal is poured into the cavity. These plates are secured in the frames in a manner which permits their replacement when desired for repair of the mold.

An object of this invention is to provide a simplified mold and system for molding wherein chill plates can be pre-positioned within a mold, prior to sand filling the mold flask, without additional labor in handling the mold and sand. The chill plates form an integral part of the wall surface of the sand cavity in the mold and remain with the flask when the solidified cast part is removed and the sand is dumped for reusing the mold.

Another object of this invention is to provide an essentially labor-free system for mounting chill plates within a sand casting mold so that the plates function to form and rapidly chill selected portions of the cast part, without increasing the time or labor involved in the casting process.

Still a further object of this invention is to provide an inexpensive system for utilizing chills for forming and rapidly cooling selected portions of metal cast in a sand mold. The chills remain with the mold cope and drag frames or cover plates for automatically positioning the chills during the time that sand is poured into the mold to form the casting cavity.

These and other objects and advantages will become apparent upon reading the following description, of which the attached drawings form a part.

DESCRIPTION OF DRAWINGS

FIG. 1 is a schematic cross-sectional view, of a closed sand filled mold, ready for casting molten metal into the shape of an automotive engine timing cam.

FIG. 2 is a schematic cross-sectional view taken in the direction of arrows 2—2 of FIG. 1.

FIG. 3 is a schematic view of a drag frame which is inverted and positioned over a pattern half mounted upon a pattern support plate.

FIG. 4 is a schematic, perspective view of an engine timing cam shaft. The figure illustrates a lesser number of projections or lobes than is common, for illustrative purposes.

FIG. 5 is a perspective, schematic view of a drag frame with chill plates fastened within the frame and with one chill plate illustrated in dotted lines, as if removed from the frame, to illustrate the positioning of the plate within the frame.

FIG. 6 is a schematic, perspective view of a pattern half, mounted upon a pattern board or match plate.

FIG. 7 is a perspective, schematic view of a flask, cut in half along its length, with a cast cam shaft located within the flask and with the sand removed.

FIG. 8 is a perspective, schematic view, showing a sand filled drag, similar to that illustrated in FIG. 5, but with the forward wall of the drag frame removed for illustration purposes.

FIG. 9 is a cross-sectional view, similar to FIG. 2, illustrating a modification wherein the chill plates are secured to a cover and base plate located above and below the flask.

FIG. 10 illustrates another modification wherein the chill plates are reduced in width and are fastened to the cover and base plates used with the flask.

FIG. 11 is a further modification, taken as if in the direction of arrows 2—2 of FIG. 1, illustrating the mold utilized without the cope and drag frames, that is, with the cope and drag frames removed following the sand filling.

DETAILED DESCRIPTION

Referring to the drawings, FIG. 4 schematically illustrates a typical engine cam shaft 10 formed of a cast steel material. The shaft includes a shaft portion 11, an enlarged end portion 12, and projections or lobes 13, 14, 15 and 16 which form cams for contacting followers or the ends of the engine valve stems or the like. Ordinarily, a typical engine cam shaft has more projections or lobes than shown here and the shapes of these cams or lobes vary considerably more than shown in FIG. 4. Thus, the cam shaft shown in FIG. 4 should be viewed as being illustrative.

It is common to harden the peripheral surfaces 17 of the lobes following the casting of the part. This may be done in a variety of ways, such as by suitable heat treating or chemical processes such as nitriding and the like. Whichever common technique is selected, the hardening requires additional handling, shipping of the parts to the site of the hardening equipment, etc. Thus, it would be desirable to harden the peripheral surfaces 17, to the degree required, in the casting process, if possible, to eliminate much of the subsequent handling and processing steps needed for hardening. Similar problems exist with other industrial parts.

The drawings illustrate a flask 20 formed of an upper, cope frame 21 and a lower, drag frame 22. The cope frame is provided with side walls 23 and end walls 24 which are connected together at their adjacent ends to form a rectangularly shaped, open top and bottom frame. Similarly, the drag frame is provided with side walls 25 and end walls 26 which are joined together at their adjacent ends to form the open frame which matches the size and shape of the cope. The cope may be provided with a cover plate 27 and the drag is provided with a base plate 28. These plates may be loosely positioned upon the open ends of the flask or, as will be explained below, may be secured in place so that the cope and drag frames are box-like in their configuration.

The cope is provided with a series of transversely arranged metal plates 30*a*, 30*b*, 30*c* and 30*d*. These plates extend transversely between the side walls 23. Similarly, the drag is provided with lower, metal plates 31*a*, 31*b*, 31*c* and 31*d*. The lower metal plates are aligned with the upper metal plates so that they form pairs of aligned plates engaged in edge to edge, coplanar relationship. These plates are fastened by screws 33, extending through holes 34 in the edges of the plates, to the side walls of their respective frames. Thus, they normally remain in position at all times that the flask is in use, but they can be removed and replaced, when necessary, with new plates. This may be necessary when and if the plates become worn or damaged in use.

The upper plates are provided with notches 40*a*, 40*b*, 40*c* and 40*d* and, similarly, the lower plates are provided with aligned, open notches 41*a*, 41*b*, 41*c* and 41*d*. These notches are aligned so as to encircle a portion of the part cast within the mold. The thicknesses of the plates are selected to correspond to the widths of the portions of the parts that they are to form and harden. For example, the thickness of each plate corresponds to the width of the lobe formed within the notch of that plate.

The cope and drag frames are preferably formed of a metal material, as are the cover and base plates, to enhance the transfer of heat through the plates to atmosphere. Thus, the plate edges are preferably in good contact with their adjacent frame walls to which they are fastened, for implementing heat transfer.

FIGS. 3 and 6 illustrate a pattern half 45 which corresponds to one longitudinal half of the finished cam shaft 10. The pattern half is secured upon a pattern board 46, in the conventional manner. A pattern half is provided for each of the cope and drag frames and is utilized, in the conventional manner, to form the cavities within the sand arranged within the flask.

As illustrated in FIG. 3, the pattern half 45 may be arranged beneath the drag frame, which is inverted, and then positioned within the drag frame. Next, sand is poured into the frame to form part of the sand filling 47 within the flask. As illustrated, the pattern half includes lobe-like portions which fit within the respective notches of the plates during the application of the sand. Thereafter, the pattern half may be removed from the frame and, similarly, the cope frame may be filled with sand utilizing an equivalent pattern half. Next, the two frames are aligned to form the complete flask and, therefore, provide a casting cavity 48 within the sand filling. (See FIG. 1)

In forming the casting cavity, a suitable pour opening or sprue 49 may be formed by positioning a sprue pin in the cope while filling with sand. Likewise, a gate 50 is formed with a suitable form, as is conventional.

When the cope and drag are aligned and filled with sand, and the pattern halves removed to form the casting cavity 48, molten metal is poured into the pour opening 49 to fill the cavity. The metal solidifies within the cavity, contacting the sand wall of the cavity and, also, the metal edges of the notches of the plates. The metal which contacts the metal plates solidifies rapidly, with the heat transferred through the plates and frame walls to atmosphere. Such rapid chilling results in forming hard surface areas on the metal part, which areas correspond to the peripheral edges defining the notches.

Once the metal is solidified and the mold is ready to be removed, the completely cast metal part may be handled in the usual way, by removing the scrap metal riser and gate filling 51 formed by the pour passageways and gates. However, since the casting is provided with pre-selected locations of surface hardness, further processing of the part is reduced considerably and, consequently, the cost of making the part is reduced.

FIG. 9 illustrates a modification wherein the chill plates are secured to the cope cover and drag base by means of screws 53. In addition, sand fill holes 54 and 55 are formed in the cover and base, respectively. Sand may be forced through those holes, by a suitable pressurized system, for filling the cast and compacting the sand within the flask.

FIG. 10 illustrates a modification wherein the metal plates 57 are made narrower, that is, without contacting the walls of the flask. Instead, the plates are secured by screws 58 to the respective cover and base plates. Hence, when the cover and base plates are moved about and positioned, the plates remain with them for automatic positioning. This arrangement lends itself to casting multiple parts within one mold, while reducing the amount of labor required for positioning and handling the metal plates. For example, the cover and base plates may be provided with a number of rows of cooling plates so that upon alignment of the cover and base, that is, during alignment of the cope and drag frames, a number of casting cavities may be simultaneously formed within the sand filled mold.

FIG. 11 illustrates another modification wherein the flask is removed following the sand filling around the pattern to form the sand cavity. Here, the cover and base plates are of a size to permit removal of the cope and drag frames and to remain in place within the compacted sand cake, containing the casting cavity, for maintaining the metal plates in position. Thus, the cover 60 and the base plate 61 carry the metal cooling plates which are fastened to them by suitable mechanical fasteners such as screws 62.

This invention may be further developed within the scope of the following claims. Therefore, having fully described at least one operative embodiment of this invention We now claim:

1. A mold for sand casting a shaft having an elongated body with one or more integral, generally annular, radially outwardly extending lobes formed intermediate the ends of the shaft, comprising:

a flask formed of aligned cope and drag frames, which are each normally filled with sand and contain a portion of a casting cavity formed in the sand so that the casting cavities, when aligned, provide a complete enclosed casting cavity within the flask for the receipt of molten metal which solidifies within the cavity;

flat, narrow metal plates arranged transversely of the cope and drag frame, to form one or more pairs of cope and drag plates that are aligned with each other in coplanar relationship and in edge to edge contact with each other, and with the adjacent edges of the pair of aligned plates having curved, notch-like openings formed therein and aligned for defining the periphery of a lobe, said cope and drag frames each having a cover plate, formed of a heat conductive material, extending over its upper and lower surfaces respectively to thereby form a closed box-like flask, and each of said plates having an edge engaging its respective, adjacent cover plate for conducting heat thereto so that heat may be transferred from the molten metal cast in the mold, through the edge portions defining the notches in the plates, through the plates, and then through the cover and base plates respectively, to atmosphere;

the aligned notch-like openings being shaped and sized to correspond to the complete, cast peripheral shape and size of a lobe, and the plates being of a thickness which is substantially equal to the thickness of the lobe;

whereby molten metal cast into the mold cavity formed in the shape of a shaft, will fill the cavity and simultaneously contact and be enclosed within the aligned notches for rapidly chilling and, thereby, hardening the peripheral surface of the lobe cast within the aligned notches, with the portion of the shaft formed in contact with the sand wall defining the cavity being softer than the surface of the lobe periphery.

2. A mold as defined in claim 1, and including a number of similar aligned pairs of notched plates arranged within the respective cope and drag frames for simultaneously forming a corresponding number of lobes with hardened, peripheral edges resulting from the chilling contact with the plates, during the casting of a shaft in the mold.

3. A mold as defined in claim 1, and including a substantial number of similarly aligned pairs of notched plates arranged within the cope and drag frames for simultaneously forming a corresponding number of lobes within the notched plates during the casting of the metal within the cavity, with the lobes peripheral edges being hardened resulting from the contact with the plates during the casting.

4. A mold as defined in claim 1, and including a cover plate extended over each of the open upper and lower ends of the flask for forming a box-like, closed flask, within which the sand filling is located, and said plates each having an edge engaging and secured to its respective adjacent cover plate for conducting heat thereto.

5. A mold as defined in claim 4, and including a number of similarly aligned pairs of notched plates arranged within the respective cope and drag frames for simultaneously forming a corresponding number of lobes with hardened, peripheral edges resulting from the chilling contact with the plates, during the casting of a shaft in the mold.

6. A method for sand casting a cam shaft having one or more integral, generally annular, radially outwardly extending cam lobes formed on an elongated shaft, comprising:

providing a flask formed of aligned cope and drag frames;

mounting thin, narrow removable metal plates arranged on edge within and extending between the opposed side walls of the frames, with the plate arranged to be aligned, edge to edge, and coplanar, in pairs corresponding to the number of lobes to be cast, and with each pair of plates formed with opposed notches, with the notches forming a complete enclosure shaped to form a lobe therein, said metal plates each extending between the opposite spaced apart side walls of their respective cope and drag frames, which frames are formed of opposing side walls and opposing end walls joined together at their adjacent ends, and with the ends of the plates engaged with and secured to their adjacent side walls by means of removable fasteners, and with said side walls being formed of a heat conductive material whereby the plates may conduct heat to the side walls of the frames during contact with molten metal and the plates may be removed and replaced when desired;

positioning pattern halves in each of said cope and said drag frames;

filling the cope and drag frames with sand between and around the plates and forming casting cavity portions in the sand fillings of the frames aligned with and between the plate notches for casting shaft portions between the plates notches in sand;

removing the pattern halves from said cope and drag frames;

aligning the cope and drag frames and their casting cavity portions and metal plates for casting metal in the cavity and in the notches formed in plates;

pouring molten metal into said cavity for rapidly chilling the molten metal contacting the edges defining the notches and for solidifying the metal into the desired shape to form the shaft portions between the plates and the lobes within the notches, with the surfaces defining the peripheral edges of the lobes being harder than the remainder of the shaft surfaces.

7. A method as defined in claim 6, and including engaging each of the plates, at least along one of its edges, with a portion of its respective frame which is formed of a heat conductive material for conducting heat from the molten metal through the plate and its respective frame for rapidly cooling the lobe surfaces formed within the notches.

* * * * *